US005964070A

United States Patent [19]

Redl et al.

[11] Patent Number: 5,964,070

[45] Date of Patent: Oct. 12, 1999

[54] BUILDING PANEL SYSTEM

[76] Inventors: Ludwig Redl; Gorgona Boehm, both of Linden Gasse #65-#4, Vienna, Austria

[21] Appl. No.: 08/988,639

[22] Filed: Dec. 11, 1997

[51] Int. Cl.[6] ..... E04C 2/34

[52] U.S. Cl. ..... 52/581; 52/673; 52/745.09; 52/654.1; 52/745.1; 40/579; 40/572

[58] Field of Search ..... 52/654.1, 673, 52/581, 745.09, 745.1; 40/579, 580, 572

[56] References Cited

U.S. PATENT DOCUMENTS

| | | | |
|---|---|---|---|
| 593,484 | 11/1897 | Mauser | 52/673 |
| 704,066 | 7/1902 | Marsden | 52/238.1 |
| 844,940 | 2/1907 | Hotchner | 40/579 |
| 1,305,696 | 6/1919 | Dawes | 40/572 |
| 1,526,956 | 2/1925 | Copeman | 52/673 |
| 2,154,053 | 4/1939 | Schumacher | 72/116 |
| 2,164,261 | 6/1939 | Small | 72/16 |
| 2,803,903 | 8/1957 | Barry | 41/10 |
| 2,829,742 | 4/1958 | Wallace | 189/36 |
| 2,990,652 | 7/1961 | Santoro | 50/534 |
| 3,414,237 | 12/1968 | Bishoff et al. | 256/24 |
| 3,448,538 | 6/1969 | Maze | 40/572 |
| 4,019,300 | 4/1977 | Sauer | 52/665 |
| 4,084,916 | 4/1978 | Senn | 404/134 |
| 4,545,170 | 10/1985 | Shirey | 52/670 |
| 4,611,450 | 9/1986 | Chen | 52/309.4 |
| 5,421,557 | 6/1995 | Vise | 256/24 |
| 5,528,876 | 6/1996 | Lu | 52/654.1 |
| 5,556,080 | 9/1996 | Vise | 256/24 |
| 5,687,522 | 11/1997 | Durand et al. | 52/414 |

*Primary Examiner*—Carl D. Friedman
*Assistant Examiner*—Phi Dieu Tran A
*Attorney, Agent, or Firm*—Alan R. Thiele

[57] ABSTRACT

Two sheets having geometric perforations formed in a regular pattern are mounted such that they are spaced apart in parallel planes and the geometric perforations are congruent. The pair of sheets may be used either for the decoration of the facade of a building or as an interior structural building component.

18 Claims, 13 Drawing Sheets

FIG. 11
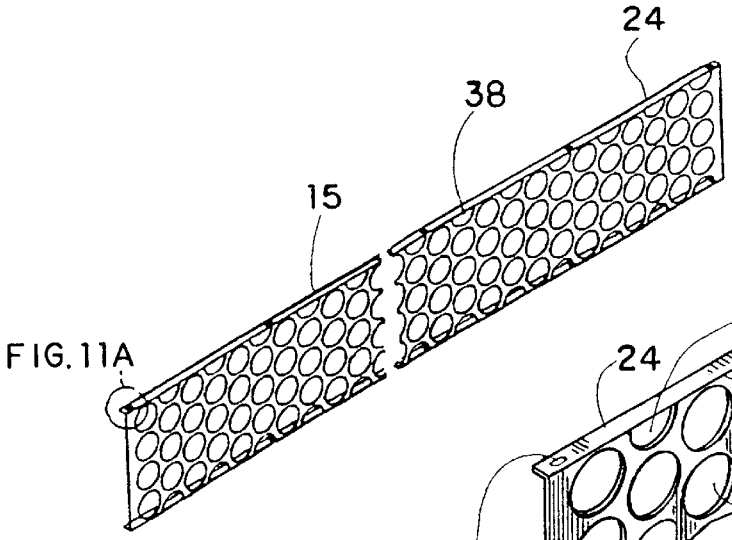
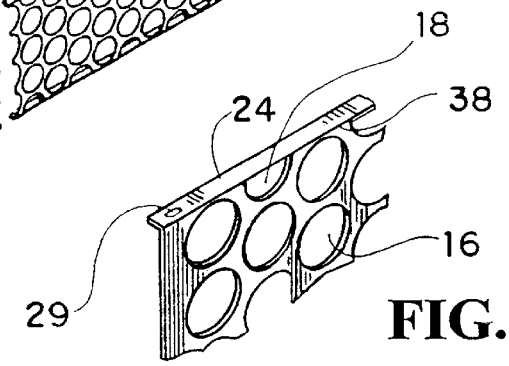
FIG. 11 A
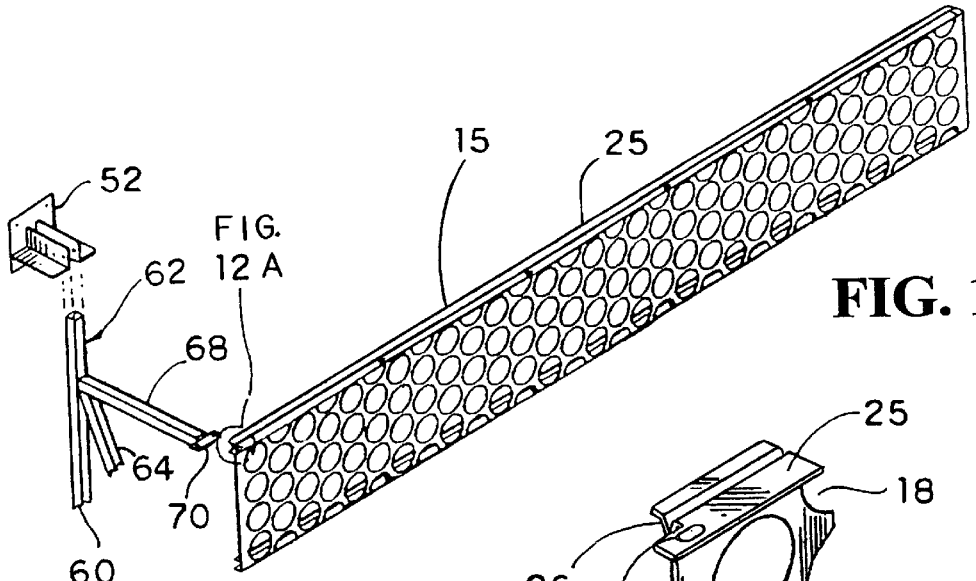
FIG. 12
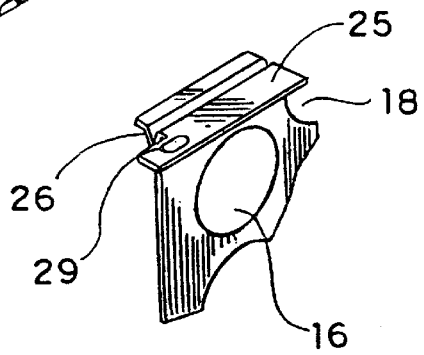
FIG. 12 A

BUILDING PANEL SYSTEM

FIELD OF THE INVENTION

The present invention relates to building panel systems; more particularly, the present invention relates to decorative building panel systems which may be used either on the exterior of a building or within a building.

BACKGROUND

As the cost of new construction continues to escalate, new and different ways are being looked at to revitalize both the interior and exterior appearance of old buildings. Such revitalization should be inexpensive and easy to install. In addition, escalating costs continue placing competing demands on architects and interior designers to do more with less resources. Such competing demands require looking for new visual effects that can be created with a minimum amount of material and labor.

There is therefore a need in the art for a new building panel system that can be used either to decorate the exterior or within the interior of a building to create new visual effects. Such building panel system should be inexpensive to make and easy to install.

SUMMARY

The decorative building panel system of the present invention creates a new visual effect on the exterior or within the interior of a building. It includes a first sheet of perforated material and a second sheet of perforated material. In the preferred embodiment, the perforations have a geometric shape, are formed in a regular pattern and occupy from about 40% to about 65% of the surface area of the sheet of material. The first and second sheets of perforated material are mounted to a space frame structure so that they are spaced apart and substantially parallel. Such mounting should also cause the perforations in the first and second sheets to be congruent. Because of visual interference to an observer caused by hole alignment, the building panel system of the present invention actually has a visual focal length. To the viewer, the interference of the perceived visual image of the holes in the first sheet and the perceived visual image of the holes in the second sheet creates an illusion of waviness or a light-dark-light-dark appearance.

BRIEF DESCRIPTION OF DRAWINGS

A better understanding of the decorative building panel system of the present invention may be had by reference to the drawings wherein:

FIG. 11 is a perspective view of a first embodiment of a mounting system for the building panels used in the decorative building panel system of the present invention;

FIG. 11A is a detailed perspective view taken from FIG. 11;

FIG. 12 is an exploded perspective view of a second embodiment of the mounting system for a building panel used in the decorative building panel system of the present invention;

FIG. 12A is a detailed perspective view taken from FIG. 12;

BRIEF DESCRIPTION OF THE EMBODIMENTS

Figure 1:
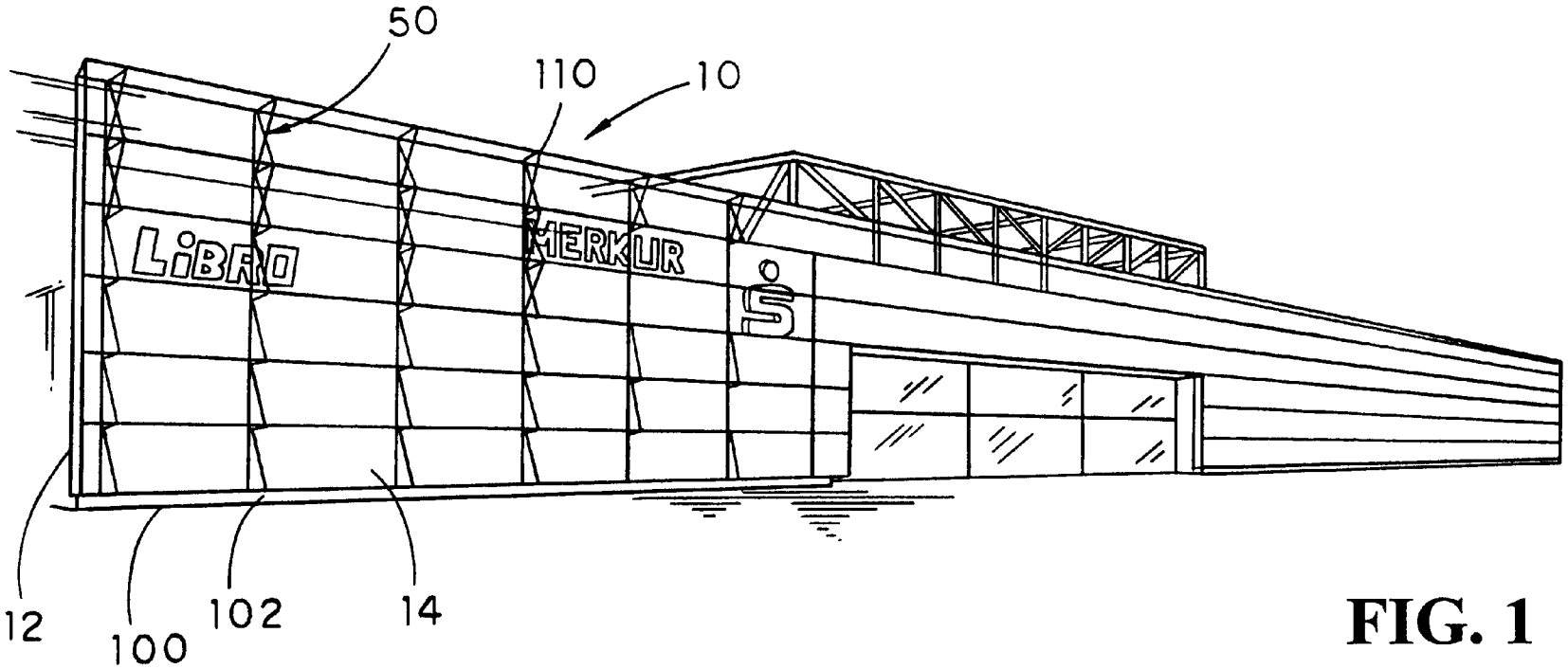
FIG. 1 is a perspective view of a building facade including the decorative building panel system of the present invention.

The decorative building panel system 10 of the present invention has a wide variety of uses. In FIG. 1, a preferred embodiment of the decorative building panel system of the present invention 10 is shown mounted to the exterior 102 of a building 100. Specifically, a first or inner perforated sheet 12 is fixed in close proximity to the exterior surface 102 of a building 100. A space frame perforated sheet mounting assembly 50 is provided so that a second or outer perforated sheet 14 may be mounted in a spaced apart and substantially parallel relationship to the first or inner perforated sheet 12. It has been found that enhanced visual effects may be obtained when a neon sign 110 or the like is placed between the first or inner perforated sheet 12 and the second or outer perforated sheet 14.

Figure 2:
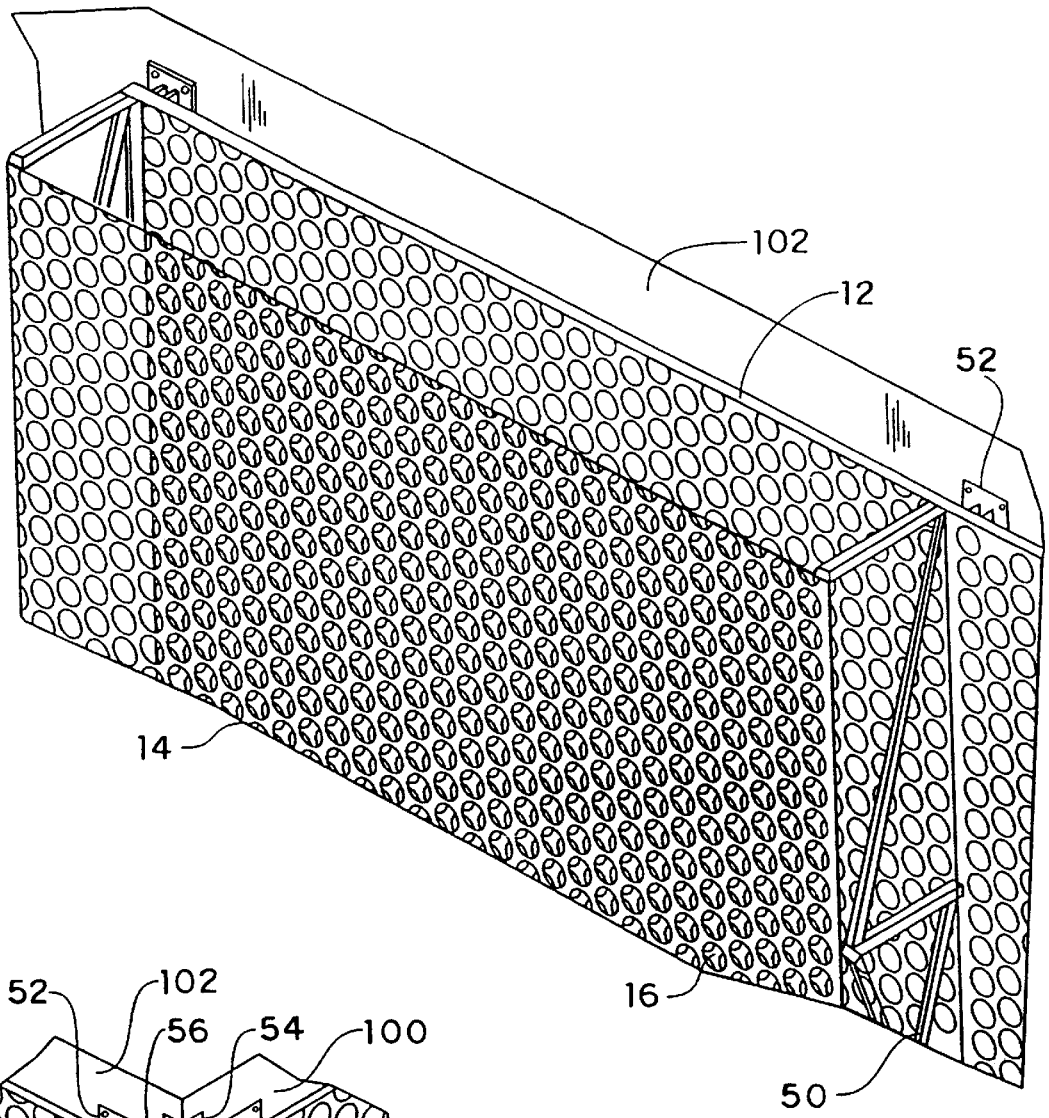
FIG. 2 is an enlarged perspective view of the building panel system shown in FIG. 1.

In FIG. 2, a more detailed view of the decorative building panel system 10 of the present invention is shown. Therein, it may be seen that the first or inner perforated sheet 12 is mounted in close proximity to the exterior wall 102 of a building 100 using a wall mounting bracket 52. A space frame mounting assembly 50 is utilized for mounting both the inner or first perforated sheet 12 and the second or outer perforated sheet 14. Those of ordinary skill in the art will understand that while a space frame mounting assembly 50 has been used in the preferred embodiment numerous other designs of mounting systems for the perforated sheets may be used without departing from the scope of the present invention. For larger buildings, it has been found that larger perforations 16 provide better effects. Similarly, if a building is substantially removed from a roadway, it has been found that larger perforations 16 enhance the visual effect. It has also been found that as the size of the perforations increases, there is a corresponding need to increase the separation distance between the perforated sheets 12, 14.

Figure 3:
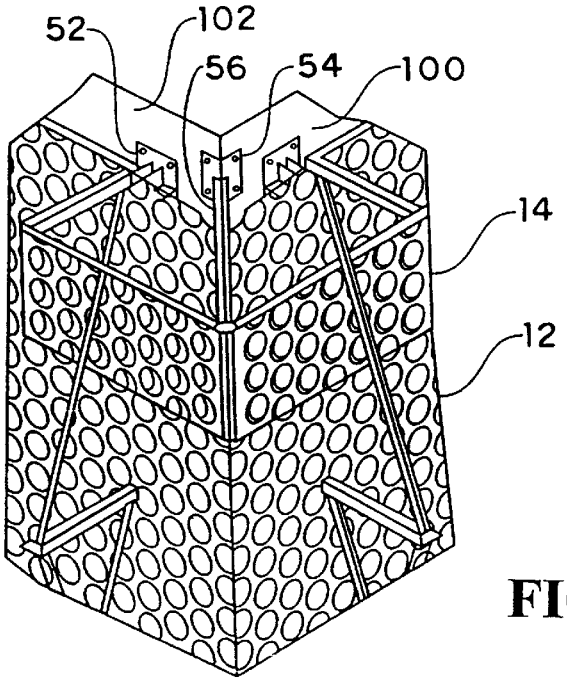
FIG. 3 is an enlarged perspective view of a corner of the building shown in FIG. 1.

In FIG. 3, it may be seen that the decorative building panel system 10 of the present invention may also be utilized on the comers of a building 100. Specifically, a comer mounting bracket 54 is used along with a comer arm 56 to mount the second or outer perforated sheet 14 in a spaced apart and parallel relationship to the first or inner perforated sheet 12 which is adjacent the exterior wall 102 of the building 100.

Figure 4:
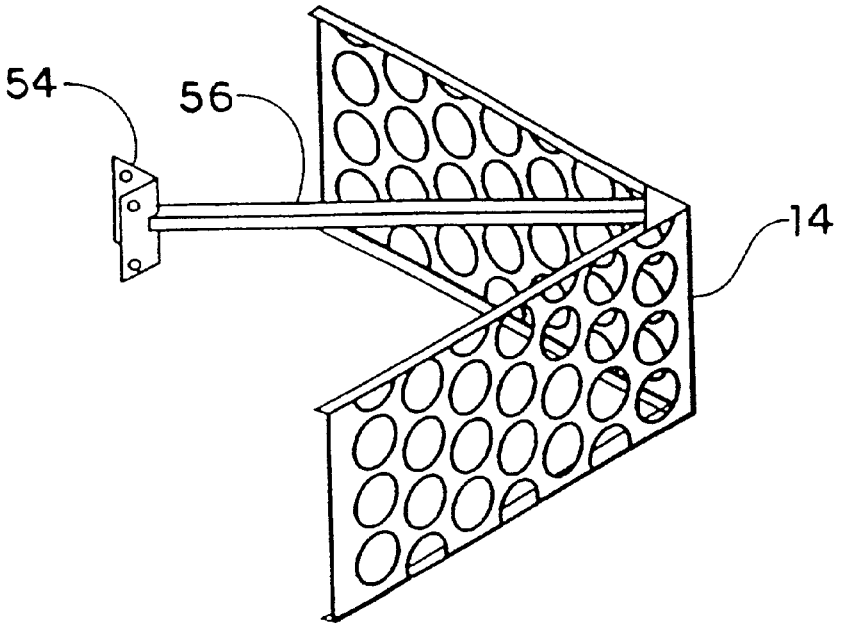
FIG. 4 is a perspective view of the mounting system for a section of the corner mounting system shown in FIG. 3.

In FIG. 4, a more detailed view of the mounting system 10 utilized at the comer of a building is shown. Specifically, the corner mounting bracket 54 attached to the comer of the building and the comer arm 56 extends outwardly to provide a mounting for the second or outer perforated sheet 14.

Figure 5:
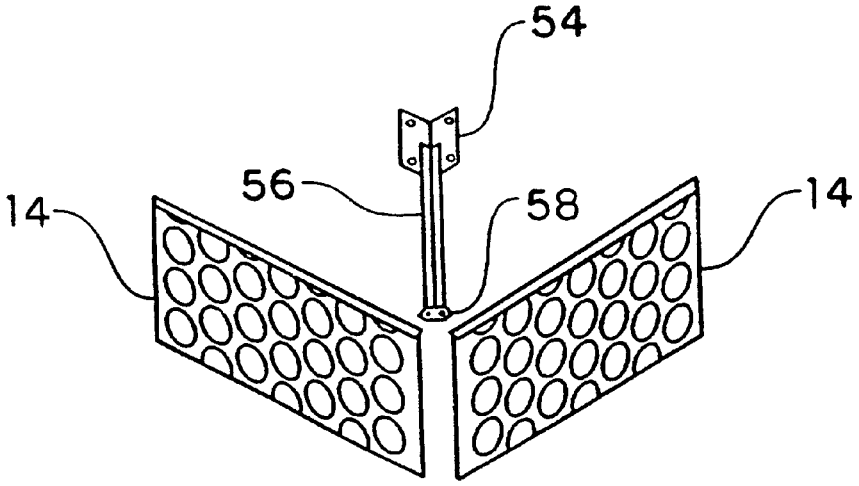
FIG. 5 is an exploded perspective view of the corner mounting system shown in FIG. 4.

As shown in FIG. 5, the comers of the second or outer perforated sheets 14 actually are mounted on a lip 58 to come together at their vertical edges 40.

Figure 6:
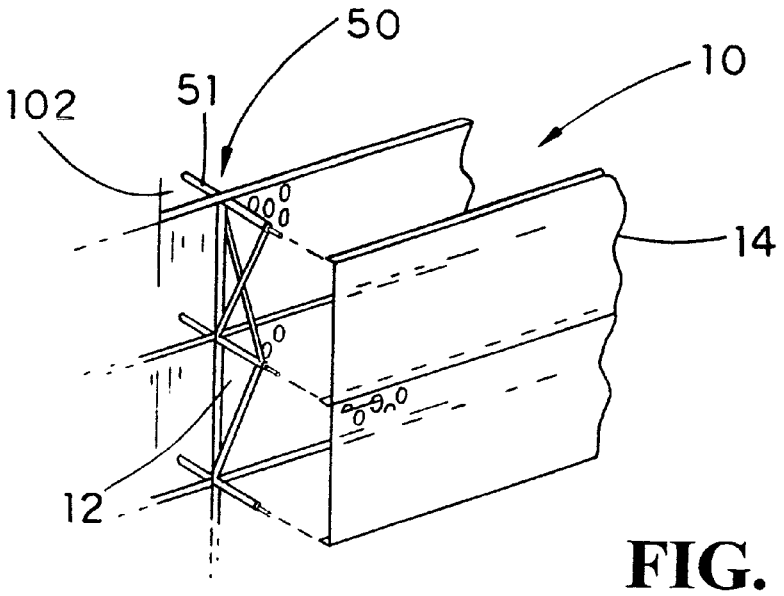
FIG. 6 is an exploded perspective view of the decorative building panel system shown in FIG. 1.

Shown in FIG. 6 is an exploded perspective view illustrating the mounting of the perforated sheets 12,14 to a space frame mounting assembly 50 on the exterior 102 of a building 106. Short support arms 51 extend from the building outer wall 102 to the first or inner sheet 12. A space frame mounting assembly 50 then extends from the first or inner perforated sheet 12 outward to the second or outer perforated sheet 14. This permits the first or inner perforated sheet 12 to be mounted in a spaced apart and parallel relationship to the second or outer perforated sheet 14. It has been found that the best visual effect is obtained when the perforations 16 in the two perforated sheets 12, 14 are substantially congruent.

Figure 7:
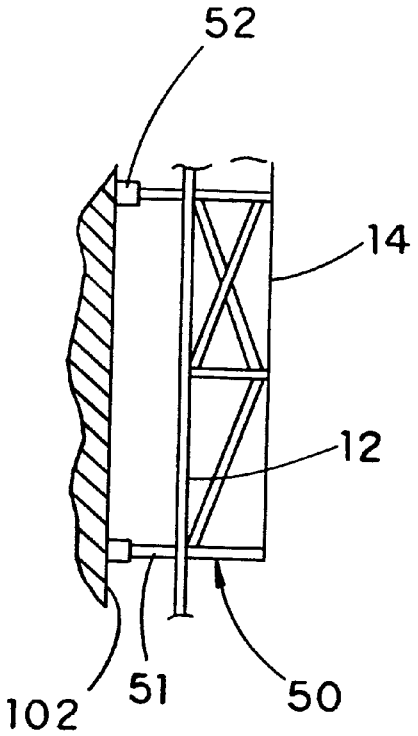
FIG. 7 is an enlarged end view of the decorative building panel system shown in FIG. 6.

FIG. 7 is shows an end view of the mounting of the decorative building panel system 10 of the present invention to the exterior wall 102 of the building 100. Therein wall mounting brackets 52 are placed against the outer wall 102 of building 100 and short bracket arms 51 are used to place the first or inner perforated sheet 12 in close proximity to the outer wall 102 of the building 100. If desired, the first or inner perforated sheet 12 may have an insulation backing made from a material such as styrofoam. A space frame structure 50 is then used to place the second or outer sheet 14 in a spaced apart and parallel relationship to the first or inner perforated sheet 12.

Figure 8:
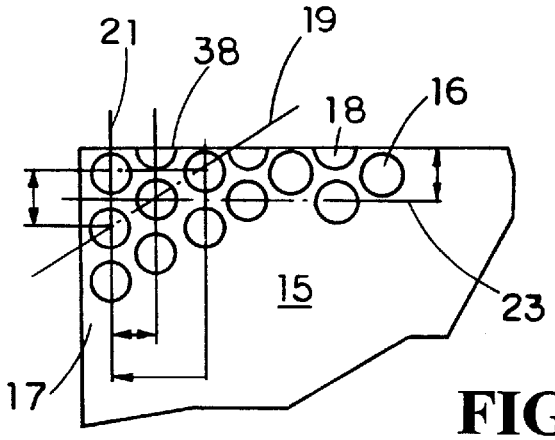
FIG. 8 is a plan view of the perforated sheet material used in the decorative building panel system of the present invention.
Figure 9:
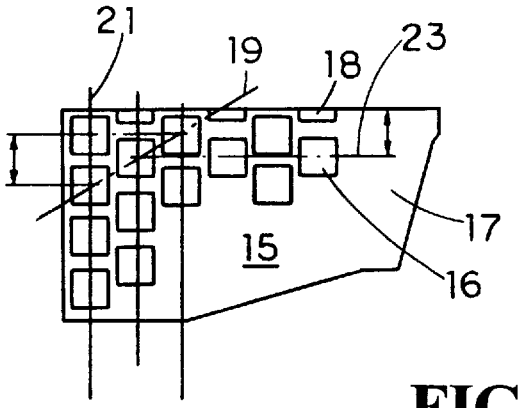
FIG. 9 is a plan view of the perforated sheet material similar to that shown in FIG. 8 but with rectangular holes.

The actual arrangement of the perforations 16 in the perforated sheets (referred to generically by reference number 15) is shown by reference to FIGS. 8 and 9. Therein it may be seen that the perforations 16 may be either circular or rectangular. In addition, polygonal perforations may be used. The perforations 16 are arranged in rows and columns. The locus 23 of the center of the perforations in adjacent rows is substantially horizontal and, of course, parallel to the locus of the centers of the perforations in adjacent rows. In adjacent columns, however, there is a stagger of the perforations 16. Specifically the stagger is illustrated by locus 19 of the center of the perforations following a 45° angle from the horizontal. For alignment purposes the locus 21 of the center of the perforations in the columns is a substantially vertical line. It has been found that the system of the present invention provides the best visual effect if the surface area of the perforations occupy from about 40% to about 65% of the surface area of the perforated sheet. Thus, the solid portion 17 of the perforated sheets occupies from about 60% to about 35% of the surface area of the sheet. Formed on the edge of the sheet are half-size perforations 18. While there is no set formula for the size or spacing of the perforations 16 in the perforated sheets 15, it has been found that the perforations 16 need to be of a sufficient size and in a suitable array to produce the desired optical waviness effect for the location at which the decorative building panel system is most frequently observed.

Figure 10:
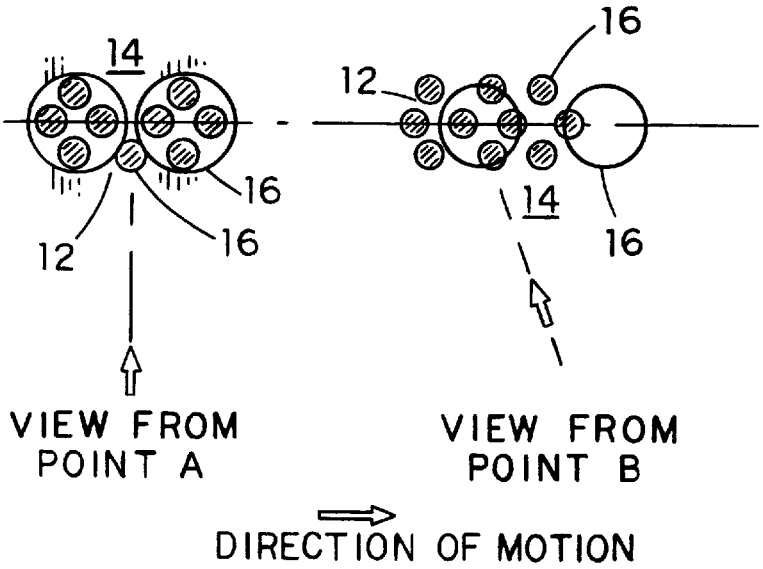
FIG. 10 is an enlarged schematic view of a pair of perforated sheets showing the optical effect obtained from utilization of the decorative building panel system of the present invention.

Shown in FIG. 10 is the visual effect which is obtained by the mounting of a first perforated sheet 12 in close proximity and parallel to a second perforated sheet 14. The viewer when moving his point of observation from point A to point B will see a different array of perforations in the rear or first perforated sheet 12 when looking through the perforations in the outer or second perforated sheet 14. This will create a waviness or light-dark-light-dark effect in the eye of the viewer. Because of the location of the perforations 16 and their positions one with respect to another, the pair of perforated sheets actually has one or more optical focal lengths.

In FIG. 11 a perspective view of a generic perforated sheet 15 is shown. Therein it may be seen that along the side edge 38 of the perforated sheet is formed a mounting surface 24. This mounting surface 24 is substantially perpendicular to the perforated surface. As may be seen in FIG. 11A, this mounting surface 24 actually bisects the perforations 18 which are formed along the edge 38 of the perforated sheet 15.

Shown in FIG. 12 is another embodiment of the mounting system for the perforated sheets. A wall bracket 52 is used to hold a single perforated sheet support assembly 60. Single perforated sheets may be of a standard size, custom sizes, or a mixture of both depending on the application. The single perforated sheet support assembly 60 includes a top arm 68, a front leg 64 and a rear leg 62. At the end of the top arm 68 is a top lip 70 which engages a mounting surface 25 as shown in FIG. 12A. As distinguished from the mounting system shown in FIG. 11A, the mounting surface 25 shown in FIG. 12A includes a rib or a ridge 26 which is formed in the mounting surface 25. This rib or ridge 26 will actually strengthen or add rigidity to the perforated sheet of material 15.

Figure 13:
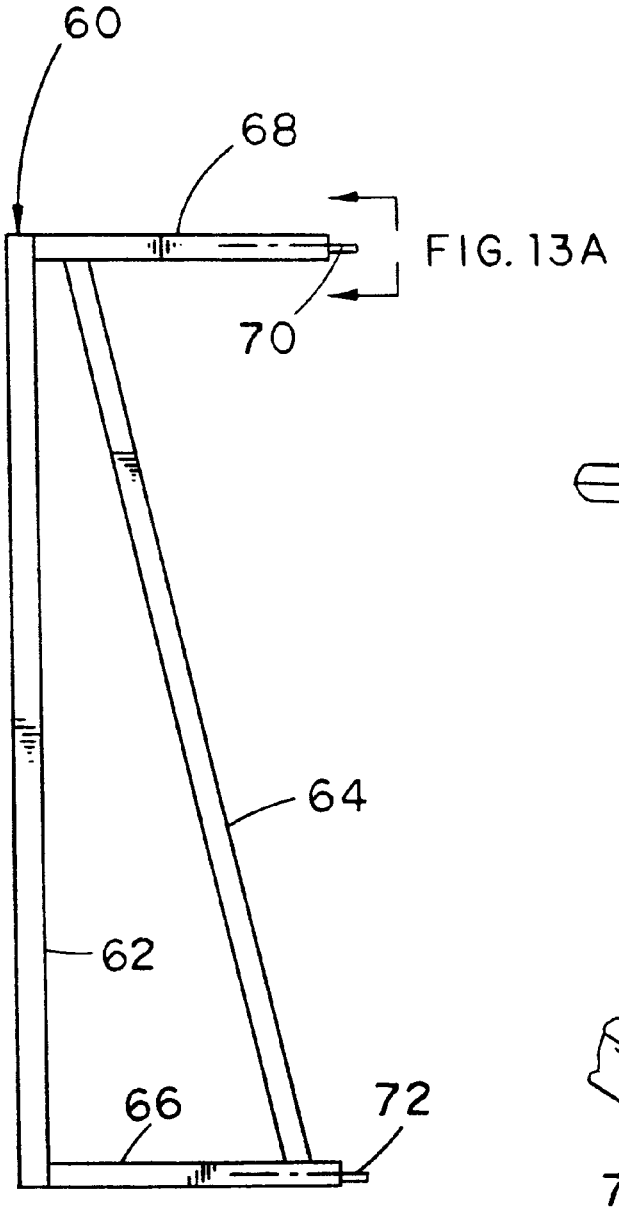
FIG. 13 is an end view of a first embodiment of a space frame mounting structure used for supporting the building panels in the decorative building panel system of the present invention.
Figure 13A:
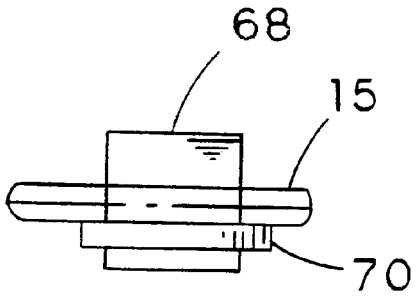
FIG. 13A is an enlarged view taken from FIG. 13.
Figure 13B:
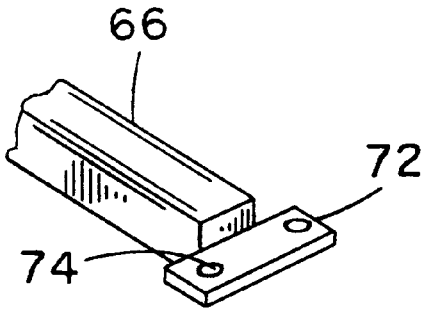
FIG. 13B is a perspective view of the support structure shown in FIG. 13A.

Shown in FIG. 13 is the single sheet mounting system 60 shown in FIG. 12. Therein it may be seen that a rear leg 62 connects to both a bottom arm 66 and a top arm 68. A front leg 64 is positioned between the bottom arm 66 and top arm 68 for support. At the end of both the bottom arm 66 and top arm 68 are positioned a bottom lip 72 and a top lip 70, respectively. As shown in FIG. 13B, these lips 70, 72 extend outwardly from the top arm 68 and bottom arm 66, respectively. As shown in FIGS. 13A and 13B, these lips 70,72 include holes 74 which allow for a fastener to be used to mount the perforated sheets 15 to the lips 70,72 formed on the top and bottom arms 68, 66 of the perforated sheet being mounted to the frame assembly 60.

Figure 13C:
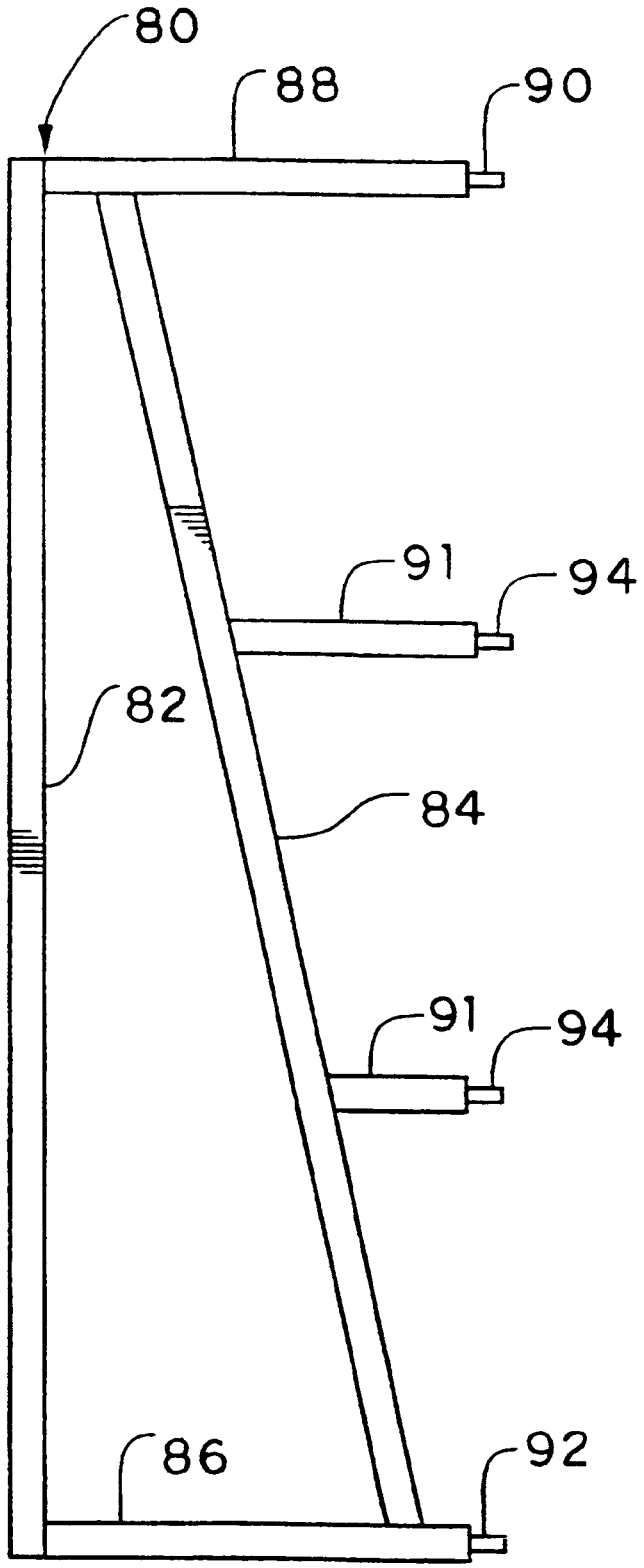
FIG. 13C is a second embodiment of a space frame mounting structure for supporting the building panels of the decorative building panel system of the present invention.

Shown in FIG. 13C is a mounting assembly 80 for multiple sheets. Note that there is a rear leg 82 which provides a mounting for a bottom arm 86 and a top arm 88. Connecting the bottom arm 86 and the top arm 88 is a front leg 84. Extending from the front leg 84 are shorter arms 91 which terminate in lips 94 which together with lips 90 ad 92 are used to mount the perforated sheets 15 of the present invention.

Figure 14:
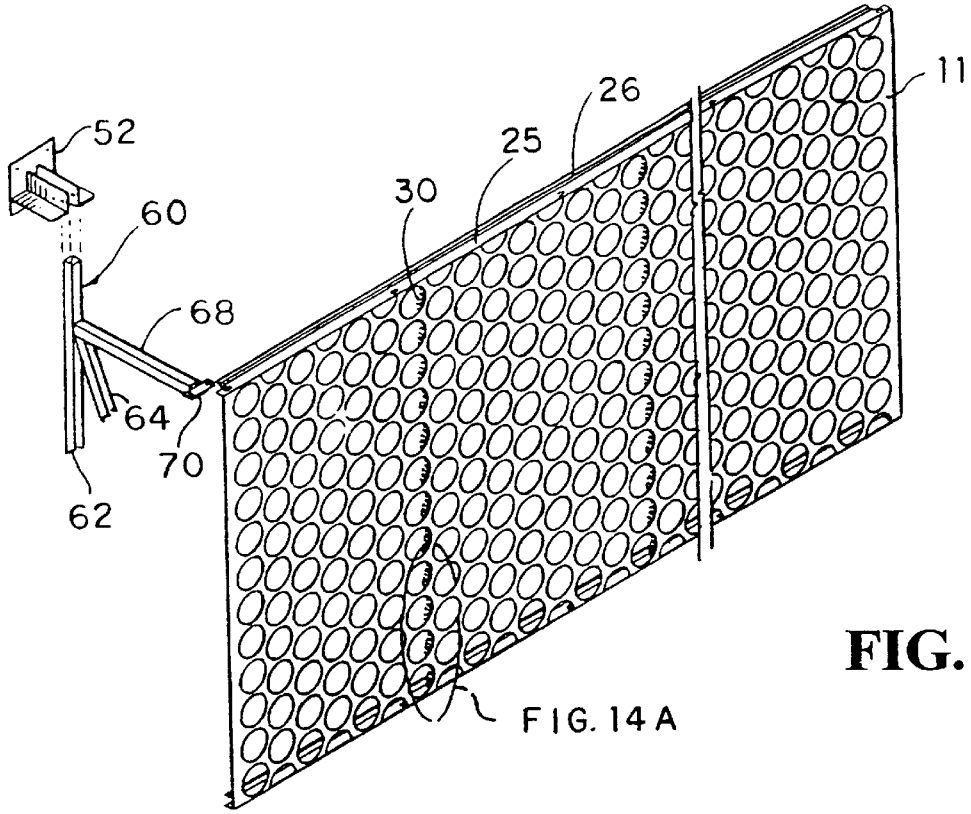
FIG. 14 is a exploded perspective view similar to FIG. 12 but further including stiffeners placed on the back of the perforated sheet.

FIG. 14 is a view similar to FIG. 12 but further including stiffeners 30 which may be used if large sheets of perforated material must employed.

Figure 14A:
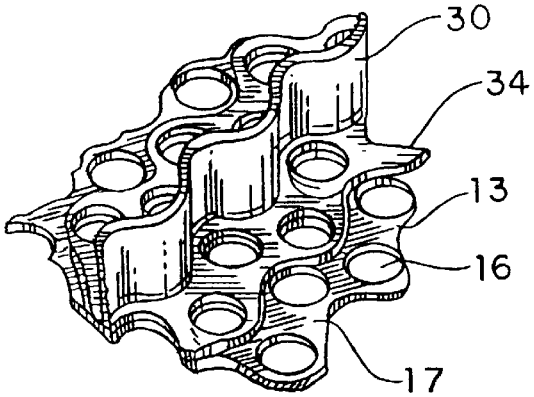
FIG. 14A is an exploded perspective view of the decorative building panel system shown in FIG. 14.

In FIG. 14A two methods of adding stiffness to the perforated sheets are shown. The first method includes the use of a perforated plate 34 which is attached to the back 13 of the perforated sheets 15 by welding or gluing. The second method includes a support ridge 30 which may be either welded or glued on its edge to the solid portion 17 between the perforations 16 formed in the perforated sheet.

Figure 14B:
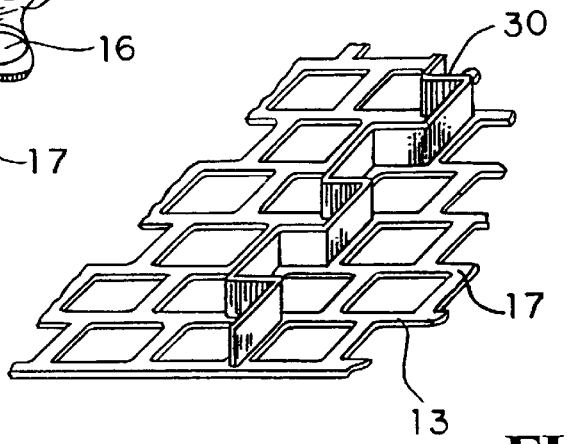
FIG. 14B is a perspective view similar to FIG. 14A but with a building panel incorporating rectangular holes.

In FIG. 14B it may be seen that a support ridge 30 may also be used with a sheet having rectangular holes. In this case, the support ridge 30 has substantially right angle bends.

Figure 14C:
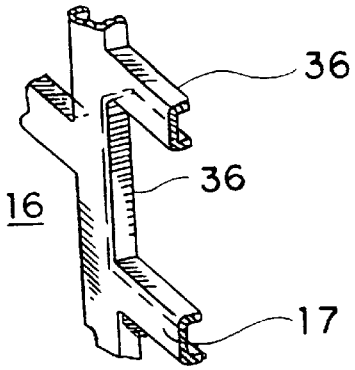
FIG. 14C is an alternate embodiment of a perforated sheet including substantially rectangular holes wherein flanges are formed around the perforations in the building panels.

Yet another method of providing stiffness to the perforated sheets is shown in FIG. 14C. Therein, it may be seen that flanges 36 may be formed around the periphery of each perforation 16. Such flanges 36 provide added structural rigidity to the perforated sheets 15.

Figure 15A:
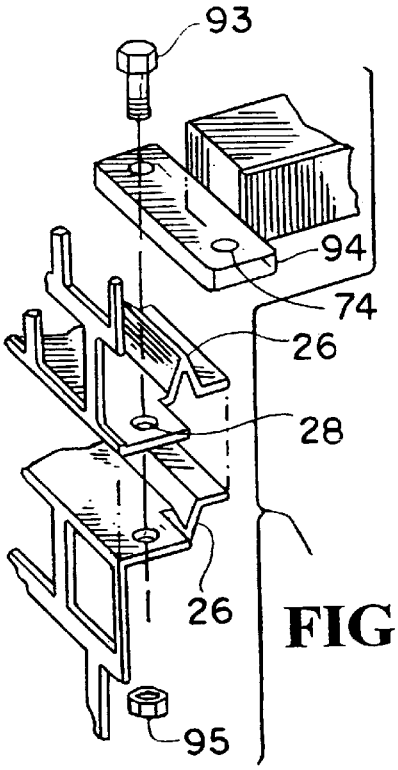
FIG. 15A is a perspective view of the mounting of the building panels to the space frame mounting structure wherein the ridges in the panels are opposite one another.
Figure 15B:
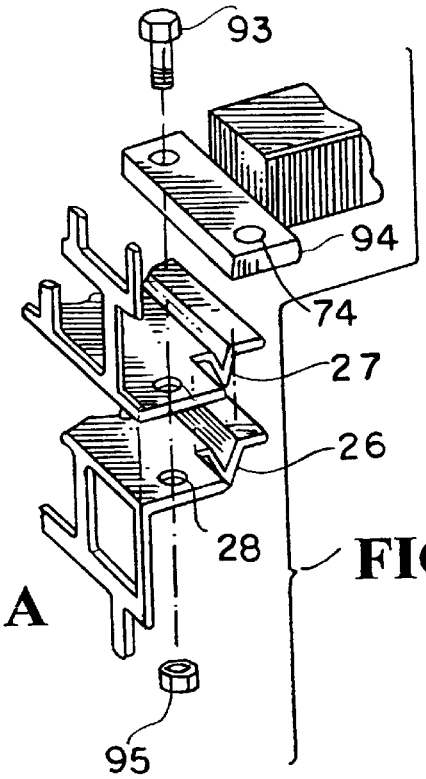
FIG. 15B is a perspective view similar to FIG. 15A, however, the ridges in the panels are nested one within another.

A more detailed view of a mounting of the perforated sheets 15 is shown by reference to FIGS. 15A and 15B. Therein, it may be seen that a bolt 93 passes through a hole 74 in the lip 94 at the end of the mounting bracket, thence through a hole 28 in the comer of a first perforated sheet, a second hole 28 in the comer of a second perforated sheet and attached is thereto by threadable engagement with a nut 95. A similar system is shown in FIG. 15B, however, by comparison with 15A, it may be seen that the ridge or rib 26 formed in the mounting surface on the edge of the sheets is nested within the adjacent rib 27 in FIG. 15B and is placed in an adjacent relationship in FIG. 15A.

Figure 15C:
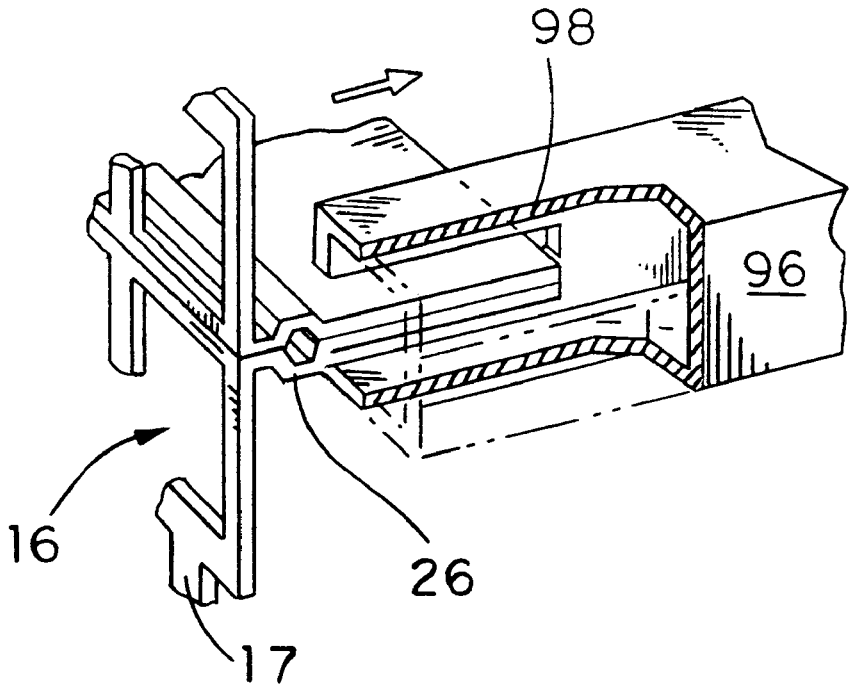
FIG. 15C is a perspective view of another alternate embodiment for mounting the building panels to the space frame structure.

In FIG. 15C yet another method of mounting the perforated sheets to the space frame mounting assembly is shown. Therein, the mounting surfaces on the sheets are placed together and slid into a slot 98 formed in the mounting arm 96.

Figure 16:
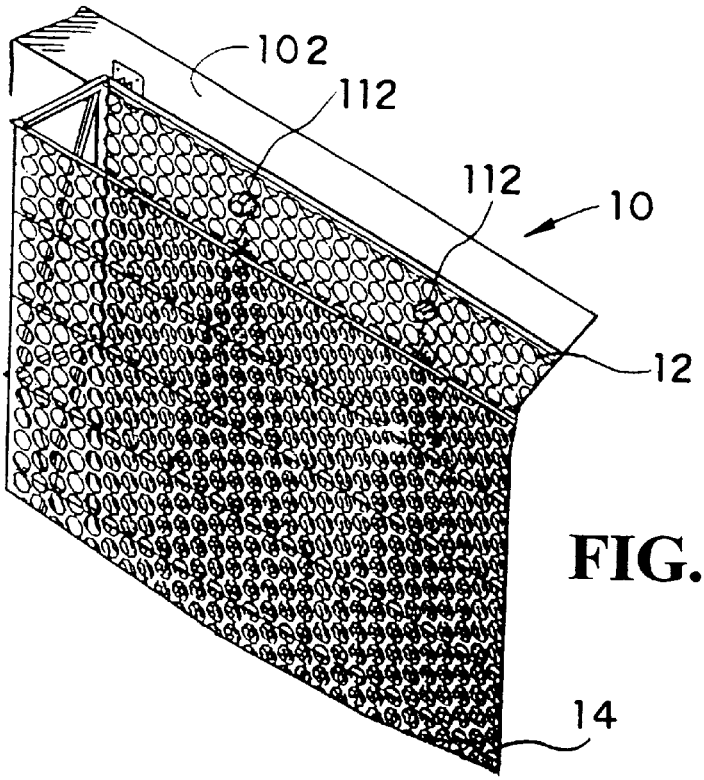
FIG. 16 is a perspective view similar to FIG. 2 but further including light fixtures.

FIG. 16 is a view similar to FIG. 2, however, two overhead lighting sources 112 are shown. The lighting sources 112 facilitate the passage of light waves between the inner sheet 12 and the outer sheet 14. Alternatively, the lighting sources may be placed to project light waves upward. It has also been found that fluorescent tubes may be used. A further enhanced effect may be had by coating the outer or front surfaces 11 of the first and second sheets 12,14 with contrasting colors.

Alternate uses of the building panel system of the present invention are shown by reference to FIGS. 17A through 17E. For interior applications, the size of the perforations is decreased and the perforated panels are placed closer together.

Figure 17A:
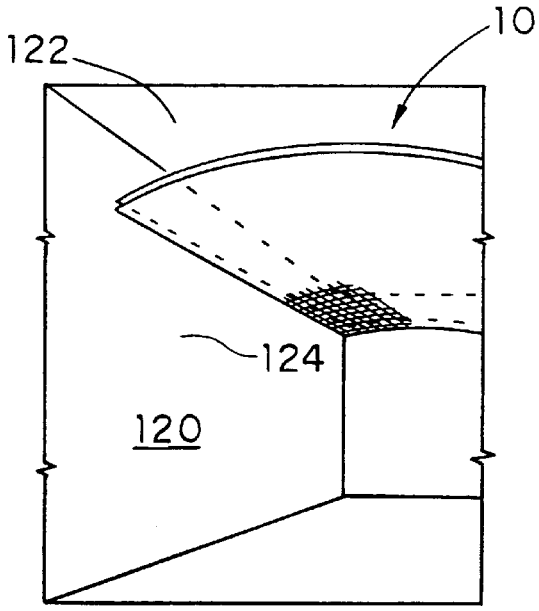
FIG. 17A is a perspective view of a room wherein the decorative building panel system of the present invention is used as a curved ceiling.

Shown in FIG. 17A is a perspective view of a room 120 wherein the decorative building panel system 10 of the present invention may be used as a curved ceiling.

Figure 17B:
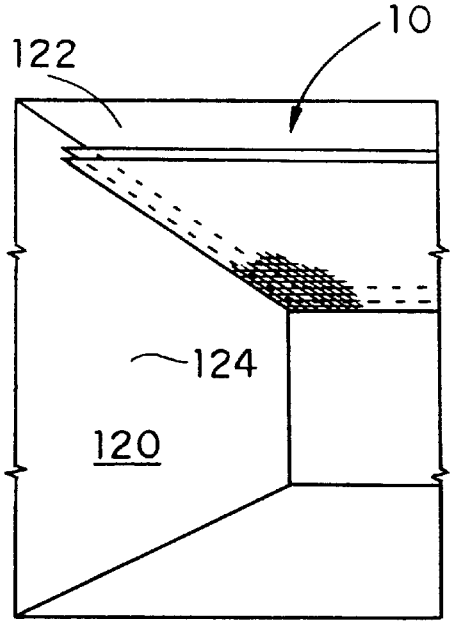
FIG. 17B is a perspective view of a room wherein the decorative building panel system of the present invention is used as a flat ceiling.

Shown in FIG. 17B, the building panel system 10 of the present invention is used as a flat ceiling system. FIG. 17B illustrates that the building panel system 10 of the present invention need not be mounted utilizing the space frame structure 50 as shown on the exterior surface 102 of a building 100. Specifically, the walls 124 of the room may actually act as a frame for holding the building panel system 10 in place. Alternatively, the perforated sheets 15 of the decorative building panel system 10 of the present invention may be suspended from a high ceiling 122 or an overhead structure such as building beams or roof trusses.

Figure 17C:
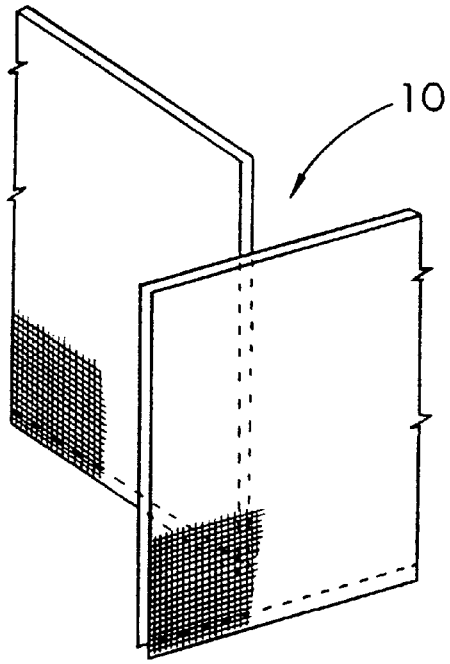
FIG. 17C is a perspective view of the decorative building panel system used as a flat wall.

In FIG. 17C is shown the decorative building panel system 10 of the present invention in use as a flat wall panel. Once again the adjacent perforated sheets may be mounted between existing walls or in a specially made frame.

Figure 17D:
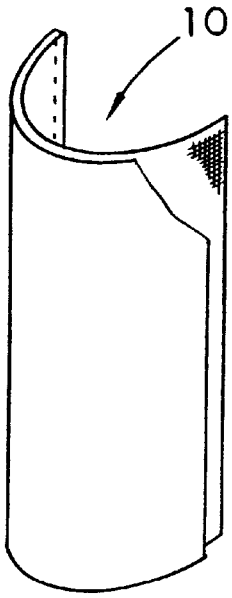
FIG. 17D is a perspective of the decorative building panel system of the present invention used as a curved wall.

In FIG. 17D the decorative building panel system 10 is shown as a curved wall. As previously indicated, the perforated building panels of the present invention may be mounted in straight or curved frames so that they are held in a spaced apart and parallel relationship one to another.

Figure 17E:
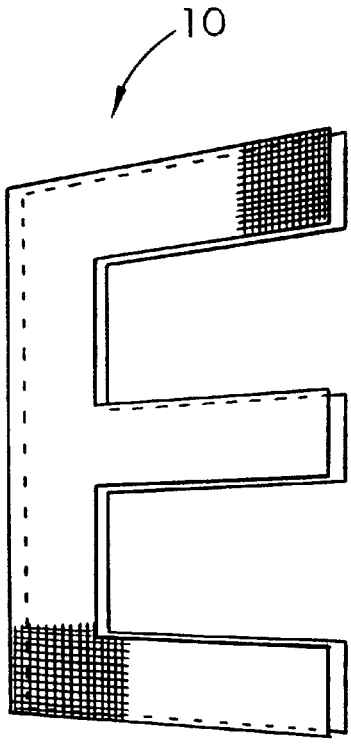
FIG. 17E is a perspective view of the decorative building panel system of the present invention used as an outdoor sign.

In still yet another embodiment as shown in FIG. 17E, the decorative building panel system of the present invention may be used to formulate letters or shapes to make an outdoor sign.

While the foregoing invention has been described and illustrated by reference to it preferred embodiment and alternate embodiments, those of ordinary skill in the are will understand that numerous other embodiments of the present invention are possible. Such numerous other embodiments shall fall within the scope and meaning of the appended claims.

We claim:

1. A decorative building panel system comprising:

a first sheet of material having a front side and a backside, said first sheet of material including an array of perforations, said array of perforations being formed in a predetermined regular pattern of columns and rows;

a second sheet of material having a front side and a backside, said second sheet of material including an array of perforations, said array of perforations in said second sheet being of the same size and being formed in the same regular pattern of columns and rows as said array of perforations in said first sheet;

means for mounting said first sheet;

means for mounting said second sheet substantially parallel to and spaced apart from said first sheet so that said perforations in said first sheet and said second sheet are substantially congruent;

at least one mounting surface formed along at least one edge of at least one of said first and second sheets of material, said at least one mounting surface being constructed and arranged for mounting said first sheet to said means for mounting said first sheet and mounting said second sheet to said means for mounting said second sheet; and at least one light source, said at least one light source constructed and arranged to send light waves between and substantially parallel to said first and second sheets of material.

2. The decorative building panel system as defined in claim 1 wherein:

the locii of the centers of the perforations in adjacent rows are substantially parallel horizontal lines, and the locii of the centers of the perforations in adjacent columns are substantially parallel, substantially 45° lines off horizontal.

3. The decorative building panel system as defined in claim 1 wherein said perforations are substantially circular.

4. The decorative building panel system as defined in claim 1 wherein said perforations are substantially polygonal.

5. The decorative building panel system as defined in claim 1 wherein said perforations are substantially rectangular.

6. The decorative building panel system as defined in claim 5 wherein said substantially rectangular perforations have rounded corners.

7. The decorative building panel system as defined in claim 1 wherein said means for mounting said first sheet and said means for mounting said second sheet further comprise a space frame structure.

8. The decorative building panel system as defined in claim 1 wherein the surface area of said perforations is from about 40% to about 65% of the surface area of said first and second sheets of material.

9. The decorative building panel system as defined in claim 1 further including substantially half-size perforations near one or more edges of said first or second sheets.

10. The decorative building panel system as defined in claim 1 wherein said first and second sheets include stiffeners, said stiffeners being constructed and arranged to not intersect said perforations.

11. A decorative building panel system comprising:

a first sheet of material having a front side and a backside, said first sheet of material including an array of perforations, said array of perforations being formed in a predetermined regular pattern of columns and rows;

a second sheet of material having a front side and a backside, said second sheet of material including an array of perforations, said array of perforations in said second sheet being of the same size and being formed in the same regular pattern of columns and rows as said array of perforations in said first sheet;

means for mounting said first sheet;

means for mounting said second sheet substantially parallel to and spaced apart from said first sheet so that said perforations in said first sheet and said second sheet are substantially congruent;

at least one mounting surface formed along at least one edge of at least one of said first and second sheets of material, said at least one mounting surface being constructed and arranged for mounting said first sheet to said means for mounting said first sheet and mounting said second sheet to said means for mounting said second sheet; and a lighted sign between said first and second sheets of material.

12. The decorative building panel system as defined in claim 11 further including a stiffening rib formed in said at least one mounting surface.

13. The decorative building panel system as defined in claim 11 wherein said means for mounting said first sheet and said means for mounting said second sheet comprise a space frame structure which engages said at least one mounting surface.

14. The decorative building panel system as defined in claim 13, wherein said space frame structure is constructed and arranged to be mounted to the exterior surface of a building.

15. The decorative building panel system as defined in claim 11 wherein the front side of said first sheet of material and the front side of said second sheet of material are coated with contrasting colors.

16. The decorative building panel system as defined in claim 11 wherein the surface area of said perforations is from about 40% to about 65% of said first and second sheets of material.

17. The decorative building panel system as defined in claim 11 wherein said means for mounting said first sheet and said second sheet of material is at least one frame bordering said first sheet and said second sheet of material.

18. The decorative building panel system as defined in claim 11 wherein said means for mounting said first sheet and said second sheet of material includes means for suspending said first sheet and said second sheet of material from an overhead structure.

* * * * *